United States Patent [19]

Binder

[11] 4,068,346

[45] Jan. 17, 1978

[54] HANDLE FOR A HAND IMPLEMENT SUCH AS A RAKE, A BROOM, OR THE LIKE

[76] Inventor: Josef Binder, Bayerwaldstrasse 18,, 8391 Strasskirchen, Germany

[21] Appl. No.: 749,027

[22] Filed: Dec. 9, 1976

[30] Foreign Application Priority Data

Dec. 12, 1975 Germany ..... 2556058

[51] Int. Cl.[2] ..... A46B 5/00

[52] U.S. Cl. ..... 16/110 R; 15/159 R; 16/115; 56/400.18; 403/292; 403/300

[58] Field of Search ..... 16/110 R, 115; 15/159 R, 165; 56/400.1, 400.18, 400.19; 403/292, 293, 298, 300

[56] References Cited

U.S. PATENT DOCUMENTS

| | | | |
|---|---|---|---|
| 146,727 | 1/1874 | Turner et al. | 16/115 |
| 2,821,834 | 2/1958 | Walker | 56/400.19 |
| 2,827,318 | 3/1958 | White | 403/292 X |
| 3,000,656 | 9/1961 | Hollaender | 403/298 |
| 3,476,413 | 11/1969 | Coberly et al. | 403/300 X |
| 3,701,243 | 10/1972 | Durkee | 56/400.18 |
| 3,767,233 | 10/1973 | Hodge | 403/292 X |

*Primary Examiner*—Louis K. Rimrodt
*Attorney, Agent, or Firm*—Alfred H. Rosen; Frank A. Steinhilper

[57] ABSTRACT

This invention relates to a handle for a hand implement, such as a rake, broom or the like, which can be fixed to a socket of the implement, said handle comprising a plurality of individual tubular members formed of plastics material which can be connected together in end to end relationship by connecting means provided at their ends which when assembled face towards each other.

23 Claims, 12 Drawing Figures

HANDLE FOR A HAND IMPLEMENT SUCH AS A RAKE, A BROOM, OR THE LIKE

BACKGROUND OF THE INVENTION

The invention relates to a handle for a hand implement, such as for example a rake, broom, or the like, which can be fixed to a socket of the implement.

Such handles which can be from 1.60 to 1.80 meters and more in length, are usually formed of wood and meet the requirements made on them to a satisfactory extent, as regards the function for which they are intended. However, serious disadvantages arise when such handles are to be packaged or dispatched by post as in this respect a handle of the length mentioned above is extremely cumbersome and bulky. Similar disadvantages occur when the purchaser of a corresponding hand implement such as a rake, broom or the like, has to transport the handle of the implement to his home. Added to this is the fact that, by virtue of the qualities of wood found nowadays, which include a relatively large amount of waste because of the nature of the available stock of useful wood, a wooden handle leaves a considerable amount to be desired as regards cost price and weight.

SUMMARY OF THE INVENTION

This invention relates generally, as indicated, to a handle for a hand implement, such as for example a rake, broom, or the like, which can be fixed to a socket of the implement.

The invention is therefore based on the problem of structuring the handle of the kind set out above, in order to overcome the above-mentioned disadvantages, so that it can be produced more cheaply than hitherto, with a lower weight, and can be better adapted from the point of view of manageability, to the particular requirements made on it, as occur for example when packaging the handle, dispatching, manually transporting it, or the like.

According to the present invention there is provided a handle for a hand implement, such as a rake, broom or the like, which can be fixed in a socket of the implement, in which the handle comprises a plurality of individual tubular members formed of plastics material which can be connected together in end to end relationship by connecting means provided at their ends which when assembled face towards each other.

The invention is based on the concept of providing the handle in the form of a hollow plastics tube, for the purposes of saving weight and for making manufacture of the handle considerably cheaper. The manageability of such a handle in the specific case of use and the further simplified manufacture thereof are provided by the fact that the handle is made in a plurality of components in the form of individual plastics tube portions which are secured either releasably or preferably non-releasably by connecting means, at their adjacent ends which are directed towards each other. In order to provide for mass production, the individual plastics tube portions are preferably of substantially equal lengths, while in an actual embodiment the handle is composed of three tube portions, the length of each of which is a maximum of 60 cm so that when the lower end of the handle is fitted into the mounting of the hand implement, the handle has an overall length of about 175 to 178 cm.

The individual tubular members are preferably secured together by means of a detent connection, a push-in connection, a clamping connection and/or a barb connection, while a separate connecting means can advantageously be used, in the form of a connecting sleeve which can be fitted externally onto the tube ends or which can be inserted into the tube ends. If the handle has a connecting sleeve which can be fitted into the ends of the tube portions, when the tube portions have been fitted together they provide a non-releasable connection which is equal in efficiency from the point of view of stability, to the connection of a wooden handle which is of solid cross-section. At the same time, a connecting sleeve of this kind, which is fitted into the ends of the tube portions, is not visible and, if suitably constructed, ensures that the tube portions are connected together flush and have only an almost invisible seam at the connecting position. Instead of this however, inter alia for visual reasons, the connecting sleeve can also have a central peripheral collar whose diameter corresponds to the outside diameter of the tube portions and which can be for example of a different colour for visual reasons.

If a connecting sleeve which can comprise plastics material or metal is secured in or on the respective end of the tube portion, by means of a detent connection in the form of a groove and rib connection, which may advantageously also be used in combination with a taper connection, then for this purpose radial projections and recesses which cooperate for each other are provided on the end of the tube portion and at or adjacent to the two ends of the sleeve; in a preferred embodiment, the projections and recesses can be in the form of a continuous peripheral annular shoulder and annular groove.

The construction of the handle according to the invention advantageously provides for simple and cheap mass production, while the handle is of low weight, and at the same time ensures that the handle can be dispatched, packaged, transported, stored and the like, in portions which are a maximum of 60 cms in length. When then the handle is required for use, it is first assembled in a simple manner, with only a small amount of work, the above-mentioned connection preferably being a non-releasable one as it is then usually no longer necessary for the handle to be separated off into its individual parts, once it has reached the region in which it is to be put to use.

A further important advantage of the handle according to the invention is that the connecting sleeves which are used for securing together the ends of the plastics tube portions provide an excellent degree of bending rigidity and provide a good strengthening action, in the manner of the principle of the horsetail, bamboo tube or grain stalk, although indeed the hollow plastics material tube portions used are in principle more liable to bending than a member which is of solid cross-section.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings.

DESCRIPTION OF THE PREFERRED EMBODIMENTS

Figure 1:
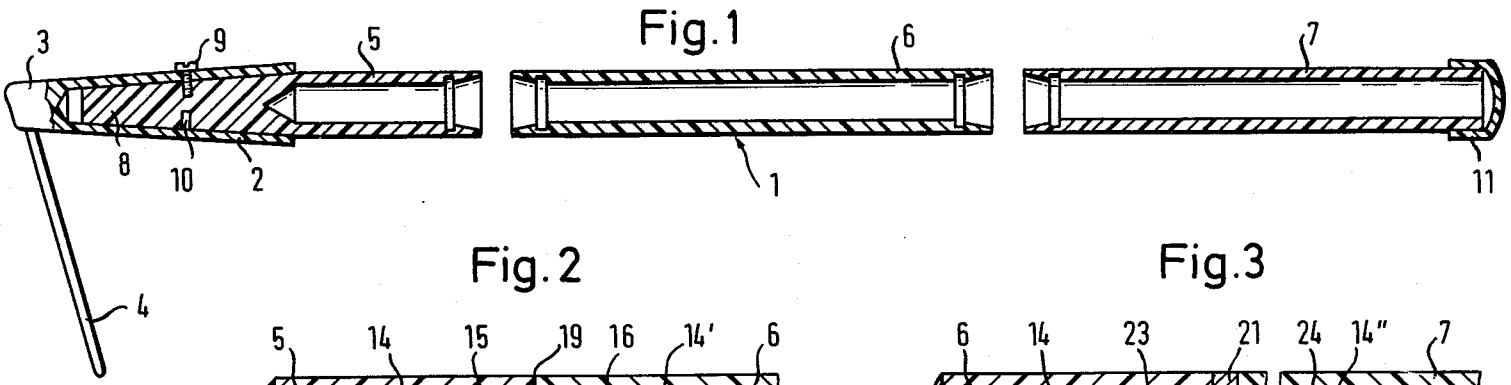
FIG. 1 shows a view in longitudinal section of the individual parts of one embodiment of the handle.
Figure 2:
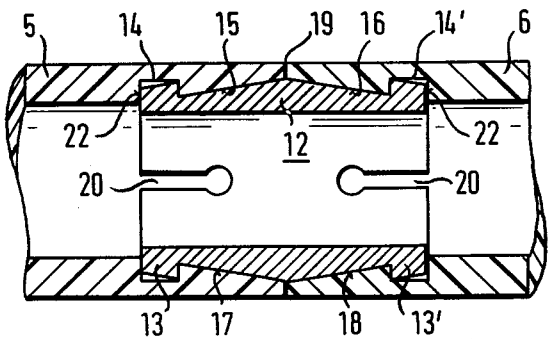
FIG. 2 shows a view in longitudinal section on an enlarged scale of the connection between two tube portions which are interconnected by means of an inserted sleeve.

As can be seen from the embodiment of FIGS. 1 and 2, the hand implement which receives a handle 1 in a socket 2 is a rake which in the usual manner carries prongs 4 on its transversely extending head 3. The handle 1 can obviously also be used on any other type of hand implement which is used for example on the land, in the garden or in the house, such as a shovel, broom, raking comb and the like.

As shown in FIG. 1, the handle 1 comprises a plurality of parts and is in the form of a hollow plastics tube; in the embodiment illustrated the handle comprises three tube portions 5, 6 and 7 which are of equal length, of a maximum of 60 cms, which are secured together at their adjoining ends by connecting means.

The socket 2 which has an internal taper receives the lower end 8 of the handle 1, which is provided with a corresponding external taper. The lower end 8 of the handle 1 is formed on one end of the lower tube portion 5. In this respect, the lower end 8 of the handle 1 can also be formed separately from the tube portion 5, and in this case it is secured to the tube portion 5 by a connecting means which corresponds to the connecting means for connecting two other tube portions 5, 6 or 6, 7.

For the purposes of additionally retaining the lower end 8 of the handle 1 in the socket 2, the implement has a nail or a screw 9 which extends through a suitable aperture in the socket 2 and which can selectively engage into one of a plurality of holes 10 which are distributed over a single peripheral line of the lower end 8 of the handle 1. Because the lower end 8 of the handle 1 has a plurality of holes 10, it is easier for the user of the implement to align a hole 10 correctly with the aperture through which the screw 9 extends.

The end of the tube portion 7 which forms the upper end of the handle is closed by a cap 11 which fits over the tube portion, although it is also possible to use a plug which is inserted into the hollow end of the tube portion 7.

The connection between the individual tube portions 5, 6 and 7 can in fact be effected without separate connecting means, insofar as the tube portions can be connected together by fitting the ends of the tube portions over each other or into each other, or clamping the ends together, and the like, in which case the ends of the tube portions are of a suitable configuration. Preferably however, separate connecting means in the form of respective connecting sleeves 12 are used, which sleeves 12 can be formed of plastics material or metal.

In the construction shown in FIG. 2, the connecting sleeve 12 has at each of its two ends a respective radially projecting preferably conically inclined annular shoulder 13, 13' which can engage into corresponding annular grooves 14, 14' provided in the inside wall of the respective tube portion at a suitable distance from the end face of the tube portion, for non-releasably connecting the individual tube portions 5, 6 and 7 together. It will be appreciated that instead of the annular shoulders 13 and 13' and grooves 14, 14' which co-operate together for the connection action, it is also possible to provide radial projections and recesses which are distributed over the periphery of the respective parts, this arrangement even providing a non-rotational connection between the individual tube portions 5, 6 and 7.

Moreover the connecting sleeve 12 has an outside diameter which, starting from its centre, reduces towards its ends so as to form two conical peripheral surfaces 15, 16 which extend in opposite directions to each other in the manner shown in FIG. 2. The surfaces 15, 16 co-operate with similarly shaped internal conical peripheral surfaces 17, 18 which are of a length equal to that of the surfaces 15, 16 (see also FIG. 1). As the axial distance between the end face of each tube portion 5, 6 and 7 and the end wall 22 of the annular groove 14, 14' against which the respective end face of the connecting sleeve 12 abuts and which is most remote from the above-mentioned end face of the tube portion 5, 6 and 7, is equal to half the length of the connecting sleeve 12, the construction shown in FIG. 2 gives a firm, stable and secure and at the same time invisible connection, when the connecting sleeve 12 is inserted half into each of the facing ends of the tube portions 5, 6 and 7. When this is done, as shown in FIG. 2, the end faces of the ends of the tube portions come into contact so that when the individual tube portions 5, 6 and 7 bear strictly flush against each other, there is only a peripheral "seam" 19, which is scarcely visible, with this kind of connection.

Figure 4:
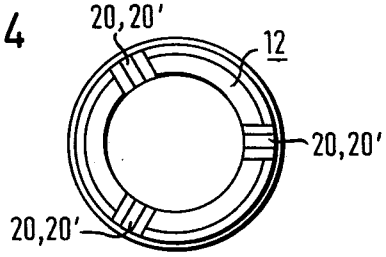
FIG. 4 shows an end view of one of the connecting sleeves.
Figure 6:
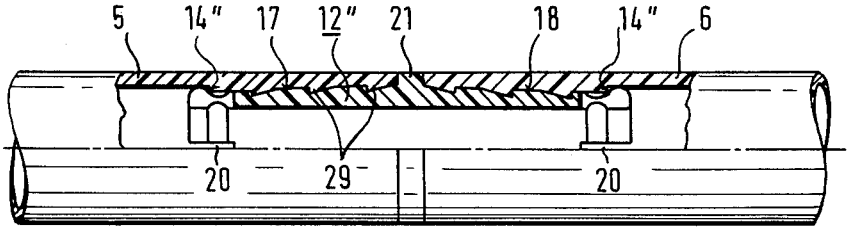
FIG. 6 shows a further form of the connection between two tube portions by means of an inserted sleeve in which a barb connection is primarily used.
Figure 7:
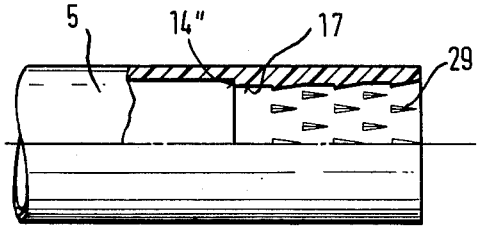
FIG. 7 shows a view partly in longitudinal section of one of the ends of the tube portions with the barbs.
Figure 8:
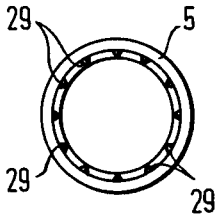
FIG. 8 shows a view of the FIG. 7 tube portion end, in end view.
Figure 9A:
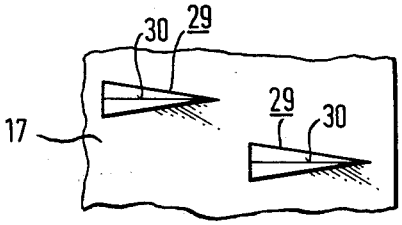
FIG. 9*a* shows some of the barbs, looking into the inside peripheral surface of the end of the tube portion.
Figure 9B:
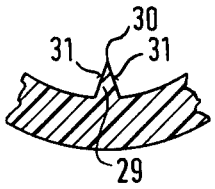
FIG. 9*b* shows a view in cross-section of the FIG. 9*a* barbs.
Figure 9C:
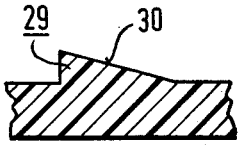
FIG. 9*c* shows a view in longitudinal section of the FIG. 9*a* barbs.
Figure 10:
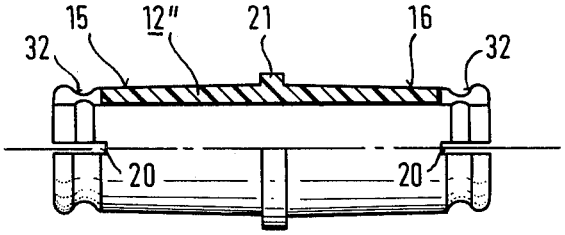
FIG. 10 shows a view partly in longitudinal section of the connecting sleeve used for the barb connection of two tube portions.

As shown in FIGS. 2 and 4, on each of its halves the connecting sleeve 12 has three longitudinal slots 20 which are arranged at equal peripheral spacings relative to each other and which open at the respective end faces of the connecting sleeve 12 and which extend over a given suitable distance towards the centre of the connecting sleeve 12 so that on the one hand when the corresponding half of the sleeve 12 is fitted into the end of the tube portion the sleeve 12 can be compressed at this point and then in turn then expand again when the annular shoulders 13 and 13' are engaged into the annular grooves 14 and 14' in the ends of the tube portions 5, 6 and 7.

It is obviously possible for each half of the connecting sleeve 12 to have not only three longitudinal slots 20 but instead four or even more slots 20. Up to eight slots 20 can be used in this connection. The number and configuration of the longitudinal slots 20 used depends on the extent to which the longitudinal slots 20 must take account of the compression at the leading end of the connecting sleeve 12 when the sleeve 12 is inserted into the ends of the tube portions, at which time the co-operating conical peripheral surfaces 15, 16 and 17, 18 are correspondingly compressed.

In this connection it is also of advantage for the peripheral parts of the connecting sleeve 12, which are divided off from each by the slots 20, to be provided at the time of manufacture with a given radially outward pre-stressing so that the peripheral parts of the sleeve 12, as defined by the slots 20, tend to extend outwardly because of their pre-stressing, when the sleeve 12 has not yet been fitted into the respective tube portions. The resulting resilient construction of the connecting sleeve 12 then means that, after the halves of the connecting sleeve 12 have been inserted into the associated ends of the tube portions 5, 6 and 7, the annular shoulders 13 and 13' of the sleeve will engage into the annular grooves 14, 14' and will remain secured therein, with an even greater degree of firmness.

Figure 3:
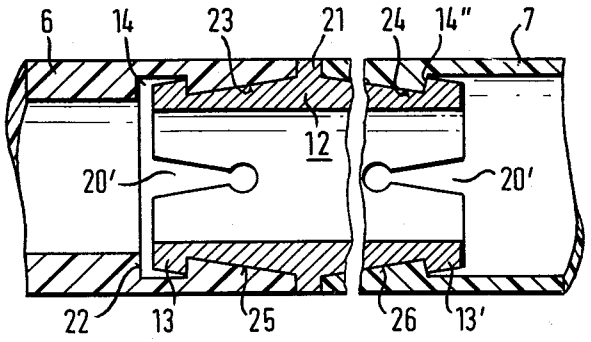
FIG. 3 shows a modified embodiment of a connecting sleeve with a central peripheral collar.

In the modified form of connection, as shown in FIG. 3, for connecting individual tube portions 5, 6 and 7 together, the connecting sleeve 12 is basically identical to the sleeve described above, but with the difference that the sleeve 12 in FIG. 3 has a central peripheral collar 21. The diameter of the collar 21 corresponds to the outside diameter of the tube portions 5, 6 and 7 and its side walls abut against the end faces of the tube portions. Preferably, the peripheral shoulder 21 is of a different colour from the tube portions 5, 6 and 7, thereby to provide the handle 1 with an overall particular visual effect. As the connecting sleeve 12 is held in position and firmly secured on the one hand by the end faces of the tube portions abutting against the side walls of the peripheral collar 21, and on the other hand by the co-operation between the walls of annular shoulder 13, 13' and annular groove 14, 14', in the manner shown in FIG. 3, this embodiment no longer requires that the wall 22 of the annular grooves 14, 14' which is most remote from the end face of each tube portion should be so arranged that the respective end of the connecting sleeve 12 abuts against the wall 22. Therefore, as shown in the left-hand part of FIG. 3, the wall 22 of the annular groove can be at a greater spacing from the corresponding end face of the inserted connecting sleeve 12, thus permitting a larger production tolerance.

For this purpose, as shown in the right-hand part of FIG. 3 which illustrates a construction slightly modified from the left-hand part of FIG. 3, the annular groove 14 can also be omitted. Instead, the respective tube portion 5, 6 and 7 can be constructed with an equal wall thickness. In that case, the internal conical surface 17 or 18 which co-operates with the conical peripheral surfaces 15, 16 of the connecting sleeve 12 is provided only at the end of the respective tube portion 5, 6 and 7; and its end remote from the end face of the respective tube portion, the conical surface 17 or 18, in conjunction with the inside peripheral surface of the respective tube portion 5, 6 and 7, forms the annular shoulder 14'' shown in FIG. 3, which co-operates with the respective annular shoulder 13' of the sleeve 12, by a detent action. In order further to improve and simplify this detent engagement action, the co-operating walls of the annular shoulder 14'' of the respective tube portion and the annular shoulder 13' of the connecting sleeve 12 can extend at an angle of inclination so that they form an approximately right angle with the associated conical surface, as shown for example in FIG. 3, instead of forming an acute angle with the conical surface, as in the above-described embodiments. Obviously, the modifications illustrated can also be used in the embodiments described hereinbefore and also hereinafter, as required.

As also shown in FIG. 3, the longitudinal slots 20' which are provided in the connecting sleeve 12 extend with a conically flaring configuration towards their mouth ends where they open at the end faces of the connecting sleeve. This means that for example fewer longitudinal slots can be used, in comparison with the embodiment shown in FIG. 2, as the longitudinal slots 20' can be reduced in width to a greater extent because of the illustrated configuration, when the connecting sleeve 12 is inserted into the ends of the tube portions. The connecting sleeve 12 is also resilient and has a pre-stressing as described above.

Figure 5:
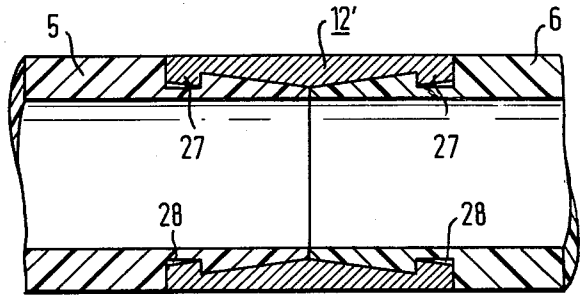
FIG. 5 shows a view in longitudinal section on an enlarged scale of a modified form of the connection between two tube portions by means of a connecting sleeve fitted on the outside thereof.

In the further modified embodiment of the connection between individual tube portions 5, 6 and 7 as shown in FIG. 5, there is a connecting sleeve 12' which can be fitted onto the corresponding ends of the individual tube portions 5, 6 and 7. The outside diameter of the connecting sleeve 12' corresponds to that of the tube portions 5, 6 and 7, in order to form a flush alignment therewith. Similarly to the embodiments described above, this connecting sleeve 12' has internal conical peripheral surfaces 23 and 24 which are formed by suitable enlargement of the inside diameter of the sleeve 12', starting from its centre and extending almost to its ends. The surfaces 23, 24 co-operate with outside conical surfaces 25 and 26 which are of a corresponding configuration and equal length, on the ends of the tube portions. The connecting sleeve 12' which is also provided with the longitudinal slots 20 or 20' (not shown in FIG. 5) has at its two ends radially inwardly projecting annular shoulders 27 which engage into annular grooves 28 provided in the ends of the tube portions at appropriate distances from the end faces thereof.

With this kind of connection, in which the connecting sleeve 12' can also be of different colour to that of the tube portions 5, 6 and 7 to be connected, it is in principle possible, in contrast to the embodiments described above, for the connection to be releasable, and such releasability can also be facilitated by making the connecting sleeve 12' of suitable configuration.

The further modified embodiment shown in FIGS. 6 to 10 is provided for making an absolutely non-releasable connection between the respective ends of the tube portions 5, 6 and 7 and the illustrated connecting sleeve 12''. For this purpose the ends of the tube portions 5, 6 and 7, which are made of a relatively hard plastics material, have barbs 29 on their internal conical peripheral surfaces. The barbs 29 are arranged and constructed as shown in detail in FIGS. 7 and 9*a* to 9*c*, in such a way that for example the internal conical peripheral surfaces 17 and 18 of the ends of the tube portions carry five rows of barbs 29, the barbs 29 of each row being circumferentially displaced relative to the barbs 29 of the adjacent rows, thus providing for example a total number of 40 barbs at each end of the tube portion. The cross-sectional shape of each barb 29 is that of a triangle, whose cross-section increases over the length of the barb 29 towards the interior of the tube portion. The cross-sectional configuration of the barb 29 is formed by side surfaces 31 which extend at an angle from a rising crest line 30.

The surfaces 17 and 18 of the tube portions 5, 6 and 7 are advantageously as long as possible and have only a small angle of inclination, for example the angle of inclination can be only from 1° to 3°, when the surfaces 17 and 18 have an axial length of about 30 millimeters.

At their inward ends, the surfaces 17 and 18 of the tube portions 5, 6 and 7 form, with the respective inside peripheral wall of the tube portions 5, 6 and 7, a radially inwardly projecting projection 14'' which approximately corresponds to the projection 14'' as shown at the right-hand side in FIG. 3 and which can also take the form of a barb-like projection, for reasons to be described in greater detail hereinafter.

The connecting sleeve 12'' provided for connecting together the respective ends of two tube portions is also advantageously made of plastics material, but in each case the material of the connecting sleeve 12'' is less hard than the material of the tube portions 5, 6 and 7. In a preferred embodiment, the connecting sleeve 12' is from 10 to 20% less in hardness than the ends of the tube portions 5, 6 and 7.

The connecting sleeve 12'' which also has a peripheral collar 21 has external conical peripheral surfaces 15 and 16 which are adapted in respect of length, inclination and other configuration to the inside conical surfaces 17 and 18 of the ends of the tube portion. The sleeve 12'' also has an annular groove 32 adjacent the surfaces 15 and 16.

In order to permit the corresponding sleeve 12 to be inserted into the respective ends of the tube portions, the sleeve 12'' also has a plurality of, for example four, axially extending longitudinal slots 20 which are arranged at uniform peripheral spacings relative to each other, as in the case of the embodiments described above. The slots 20 are of a suitable length and open at respective end faces of the connecting sleeve 12''.

As the projection 14'' provided at each end of the tube portion can co-operate with any desired part of the wall of the annular groove 32 provided in the connecting sleeve 12'' and, if it is also of a barb-like configuration, can "dig" into the concave annular groove wall, it is not necessary to pay particular attention to the axial positioning of the annular groove 32 relative to the peripheral collar 21 of the sleeve 12'', when producing the sleeve.

The two ends of corresponding tube portions 5, 6 and 7 are joined together by the connecting sleeve 12'' having its appropriate halves inserted or driven into the ends of the tube portions 5, 6 and 7. During the driving-in movement, the slots 20 are compressed and then expand again when the sleeve 12'' is fitted fully into the ends of the tube portions and the side walls of its peripheral collar 21 bear against the end faces of the tube portions. Obviously, the connecting sleeve 12'' can be of a resilient construction and can have a certain radial pre-stressing, in order to assist the action provided by the longitudinal slots 20.

When the sleeve 12'' has been completely inserted or driven into the corresponding ends of the tube portions, the barbs 29 which are provided on the surfaces 17 and 18 of the tube portions have dug into the surfaces 15 and 16 of the connecting sleeve 12'', by appropriately displacing the soft material which is provided at that position, with the result that the individual tube portions 5, 6 and 7 are non-releasably connected together, by virtue of the relatively numerous barbs 29.

It is obviously possible for individual features of the embodiments described above to be combined together as required and in dependence on the particular connection required.

I, therefore, particularly point out and distinctly claim as my invention:

1. A handle for a hand implement, such as a rake, broom or the like, said handle being in the form of a tube consisting of at least two tubular members and a coupling member for joining the individual tubular members permanently to each other flushly and with a smooth transition at their respective confronting ends, said coupling member having a separate coupling means for engaging each tubular member at one of said respective confronting ends, each coupling means being formed as a tubular part of one single coupling member, said parts being of approximately equal length and symmetrical with respect to a transverse central plane through said coupling member, each part being non-releasably joinable to the one of the respective confronting tubular member ends by means of axially-oriented connection means in the form of engaging projections on said part for mating with axially-oriented connection means of the respective tubular member ends, in combination with conical peripheral surfaces on each said part mating with corresponding conical peripheral surfaces of the respective tubular member ends, whereby said tubular members can be manually telescopically engaged with said coupling member, thereby to effect permanent end-to-end joining of said tubular members.

2. A handle according to claim 1, characterized in that each coupling member is formed as a sleeve, and said sleeve is fitted onto the ends of the tubular members confronting each other, and said sleeve is of an outer diameter corresponding to that of the tubular members.

3. A handle according to claim 1, characterised in that each coupling member is fitted into the confronting ends of the tubular members that are joined by said coupling member.

4. A handle according to claim 3, characterised in that said coupling member fits within said confronting ends, so that when the coupling member is inserted into the confronting tubular member ends, said ends contact each other at their end faces.

5. A handle according to claim 4, characterised in that the axial distance between the end face of each tubular member and the connecting means thereof that is located farthest away from said end face corresponds to one half of the length of the coupling member.

6. A handle according to claim 3, characterized in that said coupling member is insertable into each tubular member, and said coupling member has a central peripheral collar, the diameter of which corresponds to the outside diameter of the tubular members that are joined by the coupling member.

7. A handle according to claim 6, characterised in that when said two tubular members are connected together, the visible central peripheral collar of each coupling member is of a different colour from that of said tubular members.

8. A handle according to claim 1, characterised in that the engaging projections of each coupling member are designed as annular shoulders, radially projecting away at both of its said tubular parts, which interlock with annular groove shaped recesses of the confronting end of each tubular member, when said tubular members are joined together.

9. A handle according to claim 8, characterised in that the mutually cooperating walls of each annular shoulder and the mating annular groove are inclined, preferably approximately at right angles to the adjoining conical peripheral surfaces to permit easier engagement.

10. A handle according to claim 1, characterised in that the connection means of each part of the coupling member is an approximately concave annular peripheral groove, into which engages a preferably barb-like peripheral projection provided at the corresponding place of the confronting end of each tubular member.

11. A handle according to claim 1, characterised in that each coupling member is provided with two conical peripheral surfaces extending from its center in opposite directions from each other, to cooperate with correspondingly-formed conical peripheral surfaces of the confronting ends of said tubular members.

12. A handle according to claim 11, characterised in that the conical peripheral surfaces of the coupling member and of each tubular member end are of equal length in axial direction and have an angle of inclination of 1°–3°.

13. A handle according to claim 12, characterised in that at the conical peripheral surfaces of the confronting tubular member ends barb-like projections extending away radially are provided, to cooperate with the respective conical peripheral surfaces of the coupling member.

14. A handle according to claim 13, characterised in that five rows of barbs displaced with respect to each other are provided at the conical peripheral surfaces of each confronting tubular member end.

15. A handle according to claim 1, characterised in that each coupling member is provided with axial elongate slots, in said tubular parts thereof, said slots being open at the two remote ends of said parts and extending towards the center of the coupling member over a prescribed distance.

16. A handle according to claim 15, characterised in that the elongate slots gradually increase in width towards the remote ends of the coupling member.

17. A handle according to claim 15, characterised in that the coupling member is of resilient construction in at least the slotted portions of said tubular parts, for cooperation with radially acting pre-stress when present.

18. A handle according to claim 1, characterised in that each coupling member is made of a material softer than that of said tubular members.

19. A handle according to claim 18, characterised in that the degree of hardness of each coupling member is 10–20% less than that of said tubular members.

20. A handle according to claim 1, characterised in that, for coupling said handle to a rake, broom or the like, a separate connector is provided, said separate connector having a tubular end similar to the ends of said tubular members, for joining to said handle by a coupling means corresponding to the connection between said two tubular members.

21. A handle according to claim 20, characterised in that said separate connection is provided with a plurality of holes distributed over a single peripheral line for receiving a mounting screw or the like in a selected one of the holes.

22. A handle according to claim 1, characterised in that the tubular member end forming the top handle end is closed by means of a closure member selected from among a cap or a plug.

23. A handle according to claim 1, characterised in that it is assembled from three tubular members, each having a maximum length of 60 cm.

* * * * *

UNITED STATES PATENT OFFICE

CERTIFICATE OF CORRECTION

Patent No. 4,068,346 Dated January 17, 1978

Inventor(s) Josef Binder

It is certified that error appears in the above-identified patent and that said Letters Patent are hereby corrected as shown below:

Column 5, line 58, "and its end remote" should read -- at its end remote --.

Column 7, line 29, "corresponding sleeve 12" should read -- connecting sleeve 12 --.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*